United States Patent [19]

Wells

[11] Patent Number: 4,821,912

[45] Date of Patent: Apr. 18, 1989

[54] RECLOSABLE SELF-OPENING CAN END

[76] Inventor: Robert A. Wells, 13 Fairway Dr., Kennesaw, Ga. 30144

[21] Appl. No.: 57,222

[22] Filed: Jun. 2, 1987

Related U.S. Application Data

[62] Division of Ser. No. 410,422, Aug. 25, 1982, Pat. No. 4,673,099.

[51] Int. Cl.[4] ..... B65D 41/32

[52] U.S. Cl. ..... 220/231; 220/267; 220/268; 220/277; 220/278

[58] Field of Search ..... 220/269, 268, 271, 277, 220/267, 231

[56] References Cited

U.S. PATENT DOCUMENTS

| | | | |
|---|---|---|---|
| 2,294,102 | 8/1942 | Vargo . | |
| 3,281,024 | 10/1966 | Henchert et al. . | |
| 3,804,287 | 4/1974 | Balocca et al. . | |
| 3,880,319 | 4/1975 | Wells et al. . | |
| 4,003,493 | 1/1977 | Wells et al. . | |
| 4,039,101 | 8/1977 | Wells | 220/269 |
| 4,189,060 | 2/1980 | Trotman III | 220/269 |
| 4,207,991 | 6/1980 | Amabili | 220/269 |
| 4,215,791 | 8/1980 | Brochman | 220/269 |
| 4,232,797 | 11/1980 | Waterbury . | |
| 4,238,040 | 12/1980 | Vogt | 220/269 |
| 4,391,385 | 7/1983 | Rausing . | |
| 4,442,950 | 4/1984 | Wilson . | |

*Primary Examiner*—Joseph Man-Fu Moy

*Attorney, Agent, or Firm*—Jones, Askew & Lunsford

[57] ABSTRACT

A easy-open beverage container which can be selectably reclosed and reopened, after the container initially is opened. The reclosure structure may be contained on an opening tab, or alternatively may be separate from the tab.

7 Claims, 11 Drawing Sheets

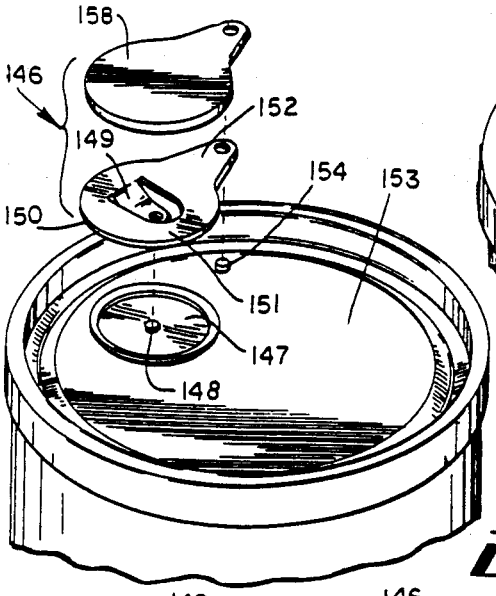
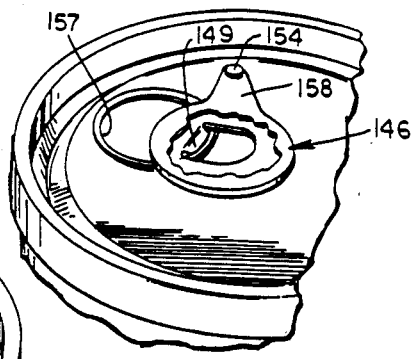
Fig_16B
Fig_16A
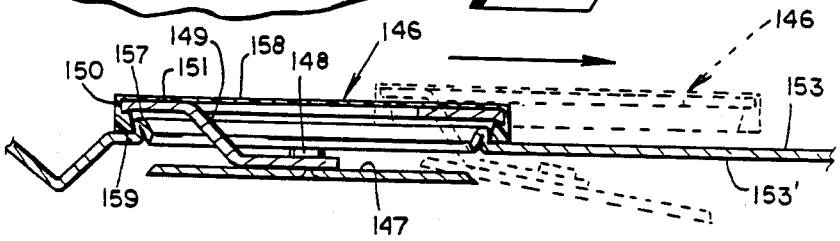
Fig_16C
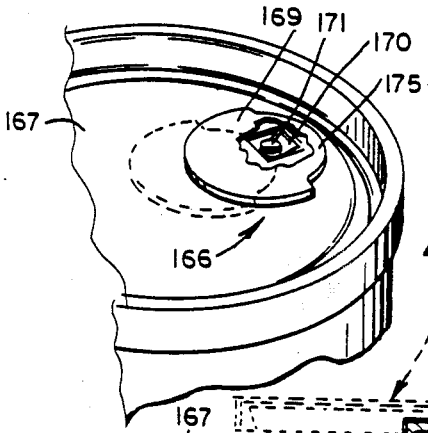
Fig_17A
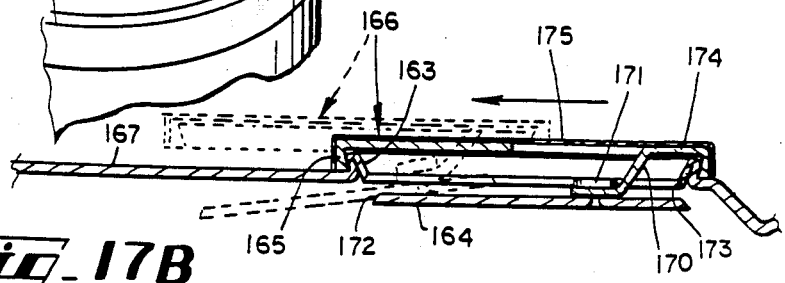
Fig_17B

RECLOSABLE SELF-OPENING CAN END

CROSS-REFERENCE TO RELATED APPLICATION

This application is a division of application Ser. No. 410,422 filed Aug. 25, 1982 now U.S. Pat. No. 4,673,099.

FIELD OF THE INVENTION

This invention relates in general to containers such as beverage cans or the like, and relates in particular to self-opening beverage cans capable of being selectably reclosed once the can is opened.

BACKGROUND OF THE INVENTION

Easy-open containers have found widespread acceptance and extensive use in various applications. Perhaps the best-known such application is in the field of beverage containers, where individual cans of beverages such as beer or soft drinks are equipped with an end wall having a manually-openable structure.

In recent years, easy-open ends intended for beverage containers have included nondetachable tabs or related elements which remained with the can after opening, for ecological reasons. Although various easy-open can ends have become known to the art, these ends generally have in common the traditional function of selectably providing a relatively small opening in the end wall of a can or other container, so that the contents of the container can be drunk or otherwise dispensed through the opening. This opening typically is formed in the can end by tearing away or otherwise detaching a removable panel from the end wall. Once this panel is detached, the container is opened and cannot be closed thereafter to protect or preserve its contents. While this presents no problem if the entire contents of the container are consumed immediately after opening, many persons find their appetites satisfied after drinking only part of a newly-opened beverage, or for some other reason desire to set aside the beverage for later consumption or use.

A partially empty beverage container needs to be reclosed in some fashion when saving the contents for later. Reclosing the container prevents or at least retard spoilage, and prevents contamination from foreign objects entering the opened container. Even where the opened container is stored in a refrigerator or other enclosure, reclosing the container helps prevent a stale taste due to commingling of odors with other foods in the refrigerator, or due to decomposition from exposure to air. Moreover, an airtight reclosure helps maintain carbonation of carbonated beverages such as soft drinks or beer.

While container reclosure may be relatively straightforward with bottles using screw-on caps, reclosing the typical beverage can is another matter. The tear-out panel associated with the typical easy-open can generally is deformed and/or positioned within the can below the end wall during the opening procedure, and thus is unavailable to reclose the opening in that wall. Prior-art expedients to overcome this problem generally have utilized separate stoppers, purchased as accesories, intended to fit on the end of an opened can and temporarily plug the opening. These separate stoppers are relatively small and easily misplaced or simply forgotten, and thus are usually unavailable to someone wanting to reclose an open beverage container. Furthermore, the structural variations between easy-open ends supplied by different manufacturers makes it difficult to provide an accessory stopper which effectively works with the variety of beverage cans commonly available to consumers.

Prior-art attempts to incorporate a reclosure on the structure of a beverage can generally have not met with acceptance in the can industry. Examples of prior art reclosures are shown in Wells U.S. Pat. Nos. 3,880,319; 3,807,597; and 4,039,101. None of the devices disclosed in these patents reveal an openable panel member that may be displaced completely away from and pivot across the top of the end wall in spaced apart relationship therefrom, and remain in non-detachable relationship thereto.

It is an object of the present invention to provide a reclosable easy-opening container made of aluminum, steel, plastic or the like.

Another object of the present invention is to provide a unitary opening and reclosure structure enabling the container to be reclosed once opened.

Another object of the present invention is to provide a non-detachable opening and reclosure tab of unitary construction where the opening and reclosure portions are confined within the same structure.

It is another object of the present invention to provide an easy-opening container relatively simple and economical to fabricate as part of the container.

It is still another object of the present invention to provide a non-detachable tab member that is both safe and easy to use for opening and reclosing of the container.

Another object of the present invention is to provide a non-removable opening and reclosure tab that may keep the pour area more sanitary prior to opening of the container.

SUMMARY OF THE INVENTION

Stated generally, container end walls equipped according to the present invention have an openable panel member defined in the wall at least in part by a selectably separable region of pre-determined weakness on the wall, and have an opening and reclosure tab member non-removably attached to the wall. The opening and reclosure tab is equipped to initiate release of the pressure within the can, in the case of a carbonated beverage or otherwise pressurized can, and to separate the panel partially or completely from the container wall. The tab member functions as an opening and reclosure means in combination, and is preferably formed as a unitary member from a suitable material such as aluminum, steel, plastic, or the like. The tab member is attached to the end wall by two means such as rivet connections located in spaced apart relationship to each other. One rivet connection is located within the area of the end wall of the openable panel member, and the other rivet connection is located in the end wall outside of the openable panel member and on the other side of the selectively separable region of weakness. The openable panel member may be separated from the end wall by the application of pressure on the opening and reclosure member in the area of the selectively separable region of weakness surrounding the openable panel member. As the openable panel member becomes detached from the end wall, the opening panel member is prevented from entering the container by the rivet connection in the panel, which is connected to the overlying tab opening and reclosure member. The tab opening and reclosure member is further held to the end wall by an arm portion that crosses a portion of the selectively separable region of the openable panel member, and which connects the opening and reclosure tab to the end wall in spaced apart relationship to the openable panel member.

The unitary opening and reclosure tab may also contain, as an optional feature, a vent opening means for release of the pressures within the container. In addition, the opening panel member may contain a selectively separable region of pre-determined weakness within the interior of the panel, forming a vent region for release of gas pressure within the can before separating the opening panel member.

The raised flanged rim of the end panel surrounding the opening panel member and the reclosure portion of the opening and reclosure tab member may lie in cooperative locking engagement with each other prior to opening and thereby provide a completely sanitary cover over the opening panel.

The raised flanged rim of the end panel surrounding the opening panel member further provides a cooperative engagement means whereby the reclosure portion of the opening tab member may readily be engaged and disengaged from the opening when desired, yet remains attached to the end wall.

DESCRIPTION OF PREFERRED EMBODIMENT

Figure 1:
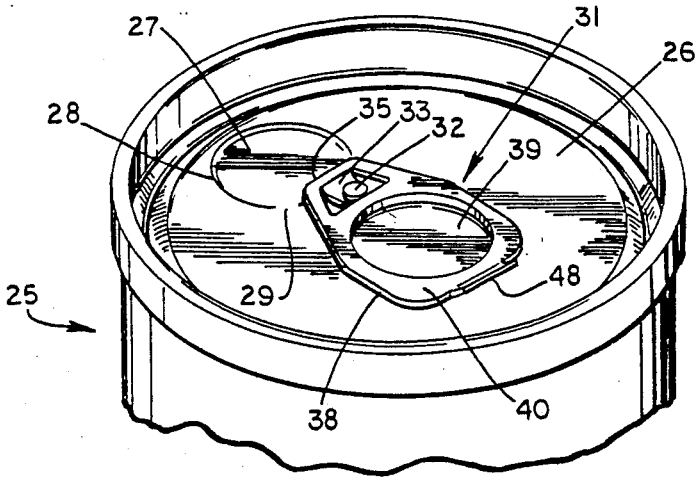
FIG. 1 is a fragmentary pictorial view of a beverage container equipped with a reclosable easy-opening and according to an embodiment of the present invention.

Turning to the embodiment shown in FIGS. 1–4, there is generally at 115 a beverage container provided with an end wall 131 according to the present invention. As shown in FIG. 1, there is a one-piece opening and reclosure tab 126, with the tab secured to the opening panel 127 by a rivet 128 integral with the panel. One end 129 of the tab 126 is pivotably attached to the end wall 131 by an integral rivet 130 formed in the end wall. A finger-engaging flange 132 is formed at the other end of the tab 126, adjacent the chime 133 of the can.

The openable panel 127 formed in the end wall 131 and defined by the score line 120 is surrounded by a raised rim 136, FIGS. 2 and 3, and at least a portion of the rim is flanged as at 137 to form a reclosure latch engageable by the cooperative flange 138 (FIG. 4) located at least at the outer end of the tab 126 below the finger flange 132.

Figure 2:
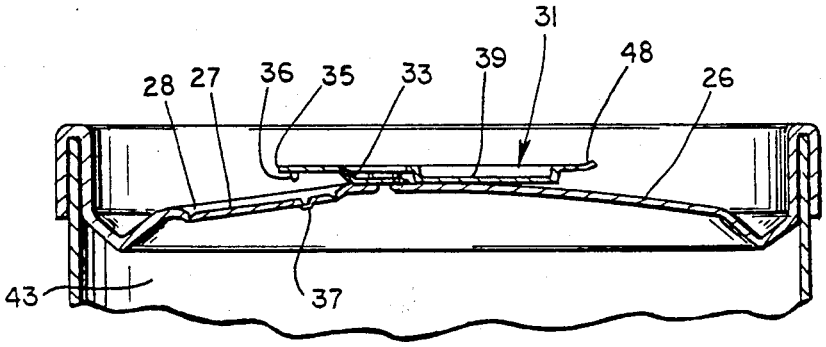
FIG. 2 is a vertical section view of the embodiment shown in FIG. 1.
Figure 3:
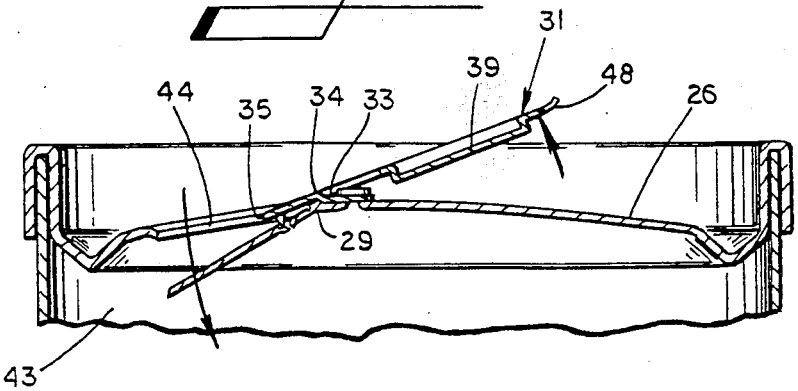
FIG. 3 is a pictorial section view of the embodiment shown in FIGS. 1 and 2, with the openable panel raised above and partially pivoted from the opening in the end.
Figure 4:
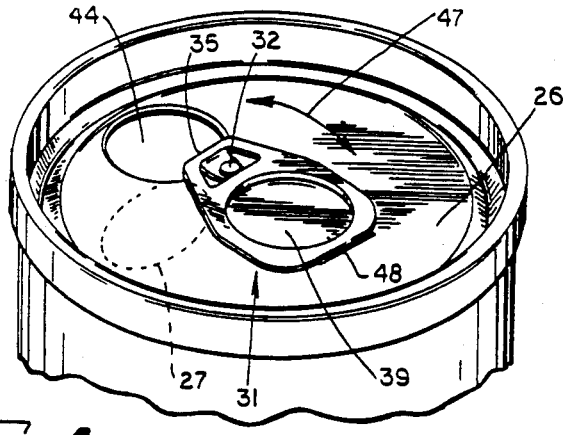
FIG. 4 is a vertical section view of the disclosed embodiment with the opening and reclosure tab member reattached to the raised flanged rim in the end wall.
Figure 5:
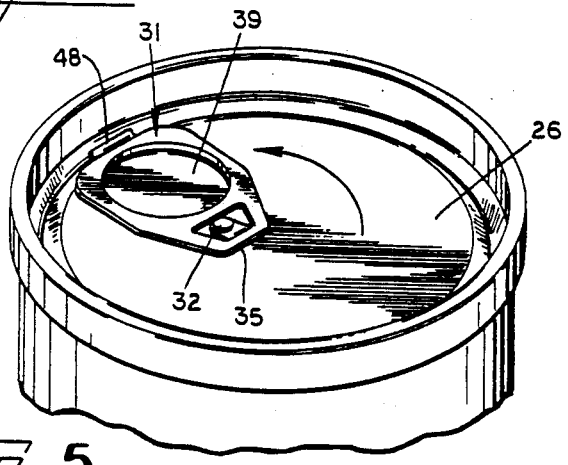
Figure 6:
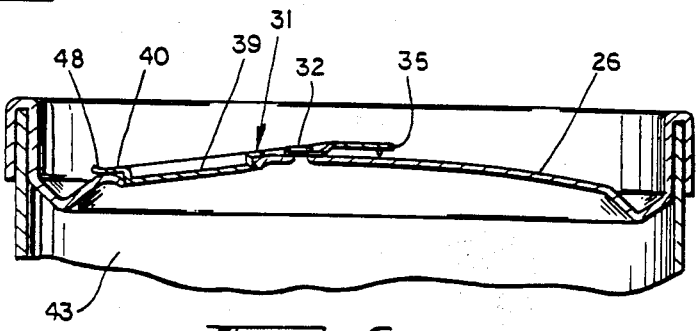
Figure 7:
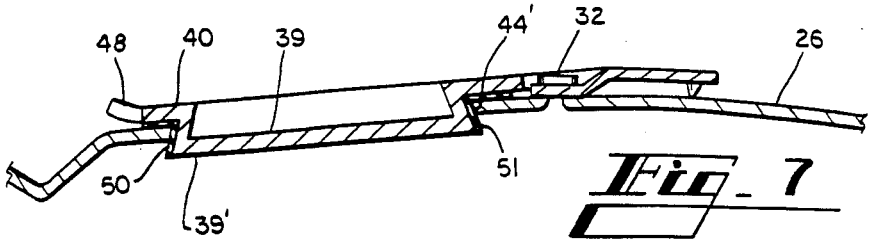
Figure 8:
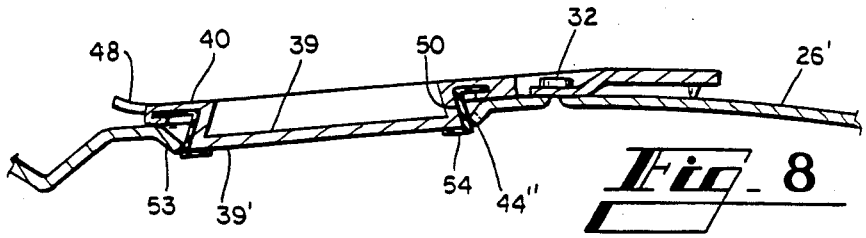
Figure 9:
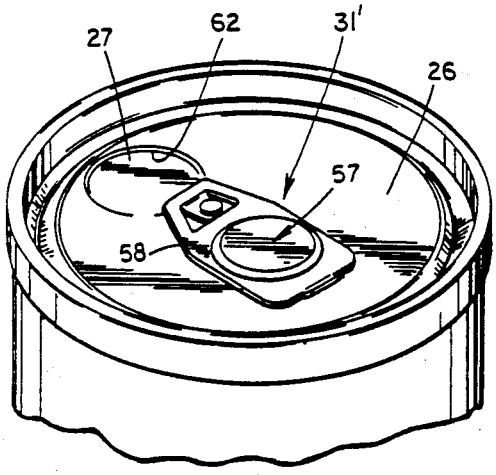
Figure 10A:
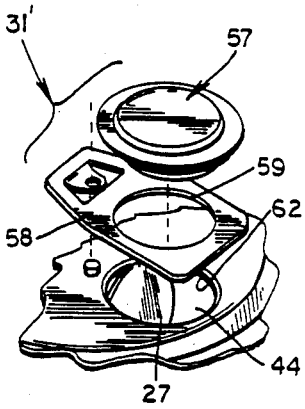
Figure 10:
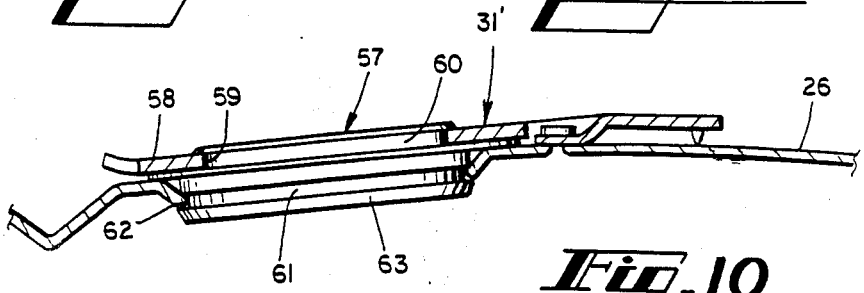
Figure 11A:
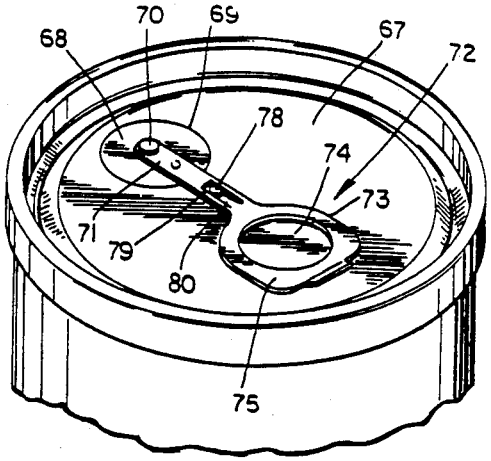
Figure 11B:
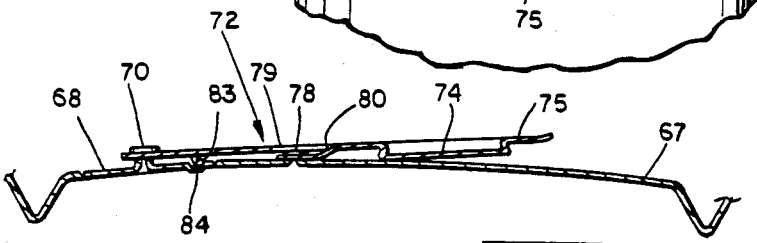
Figure 11C:
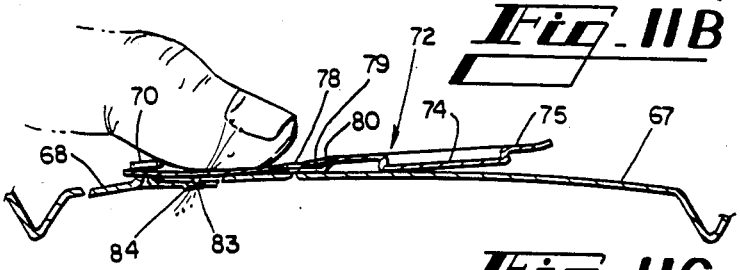
Figure 11D:
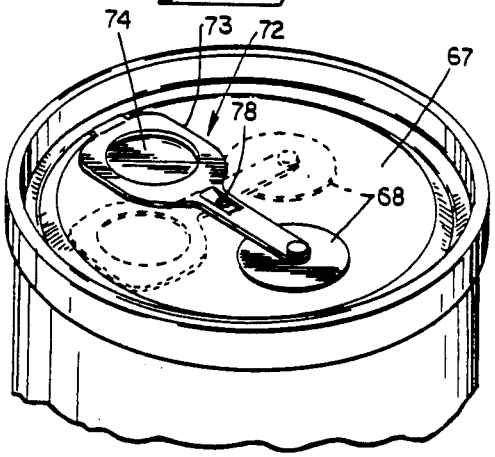
Figure 11E:
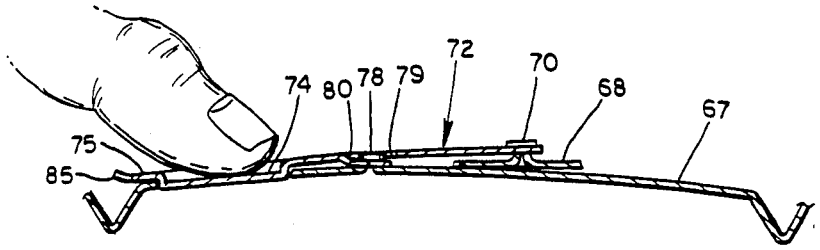
Figure 12A:
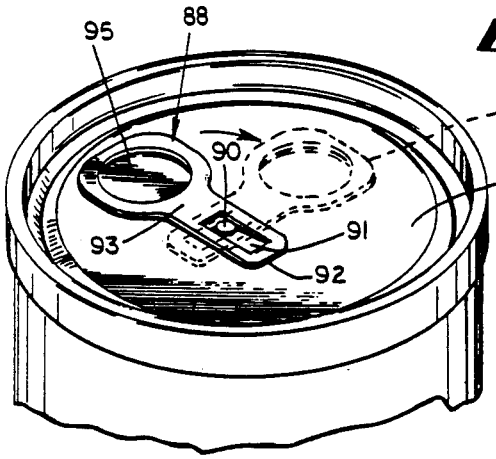
Figure 12B:
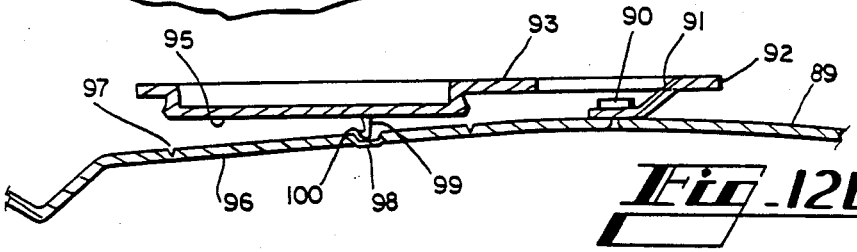
Figure 12C:
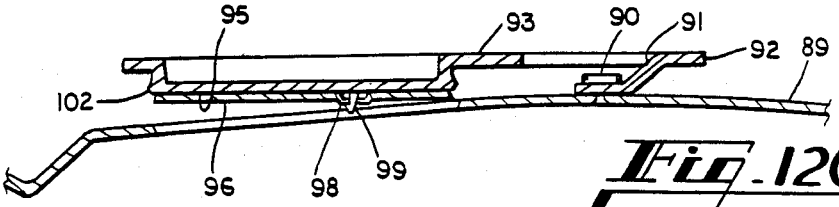
Figure 12D:
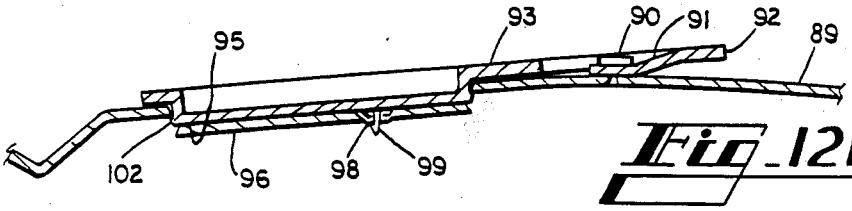
Figure 13A:
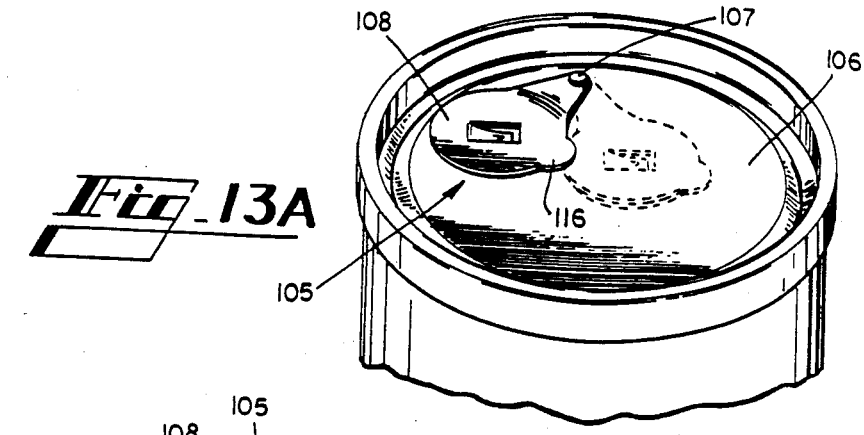
Figure 13B:
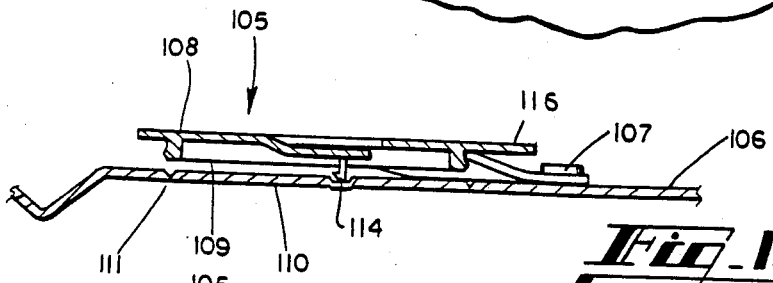
Figure 13C:
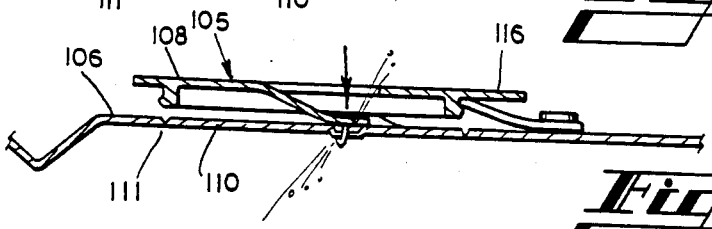
Figure 13D:
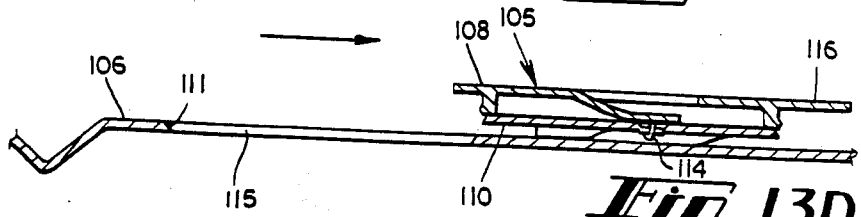
Figure 13E:
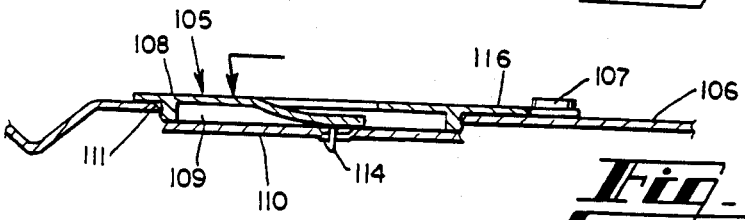
Figure 14:
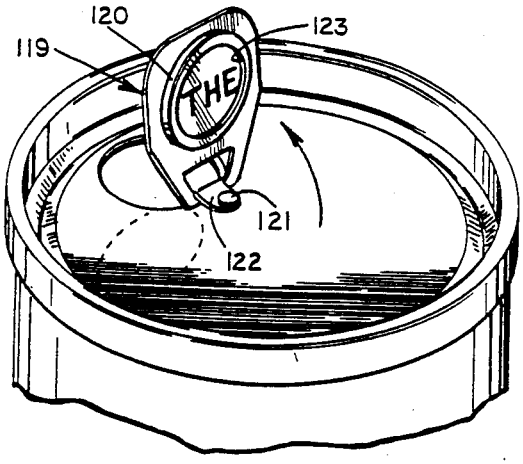
Figure 15A:
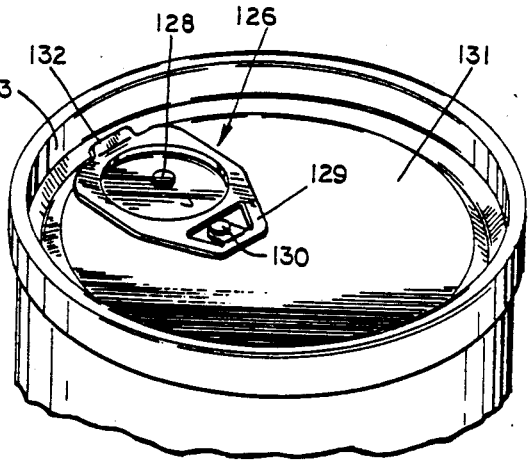
Figure 15B:
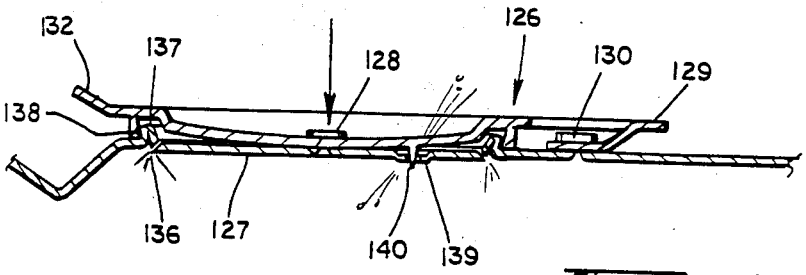
Figure 18A:
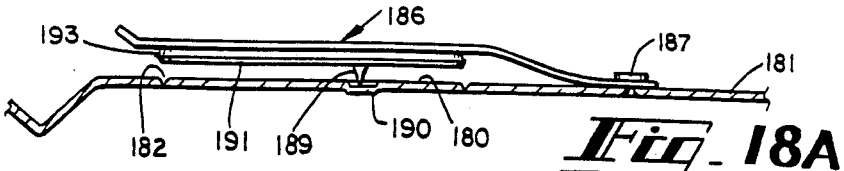
Figure 18B:
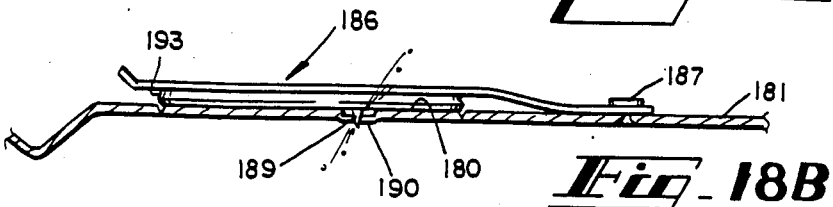
Figure 18C:
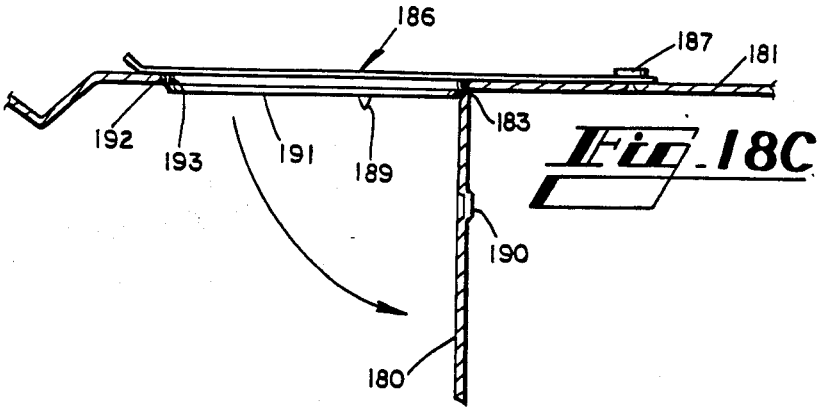
Figure 19A:
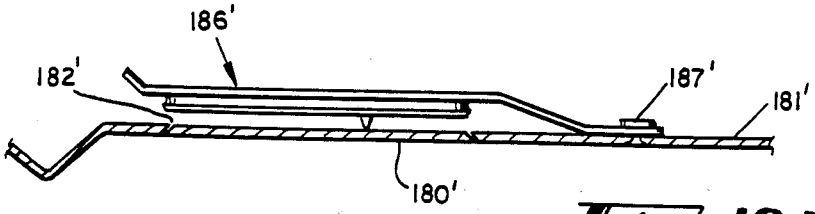
Figure 19B:
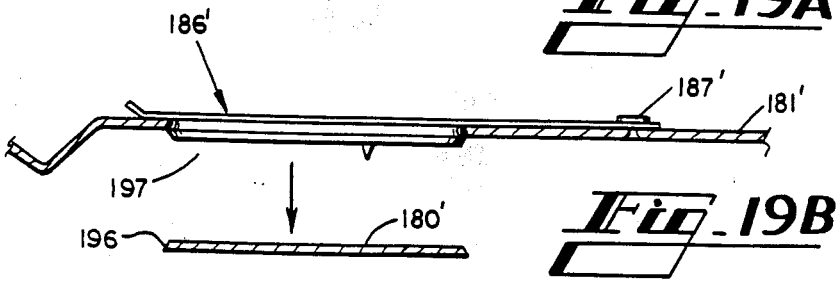
Figure 20A:
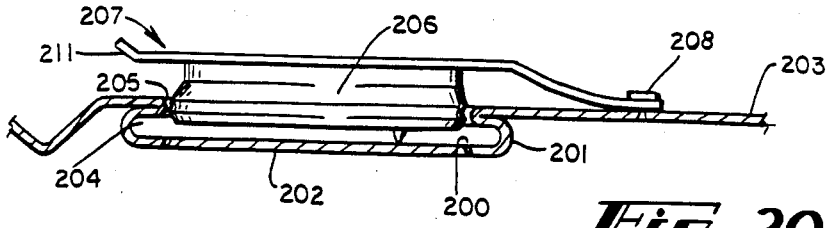
Figure 20B:
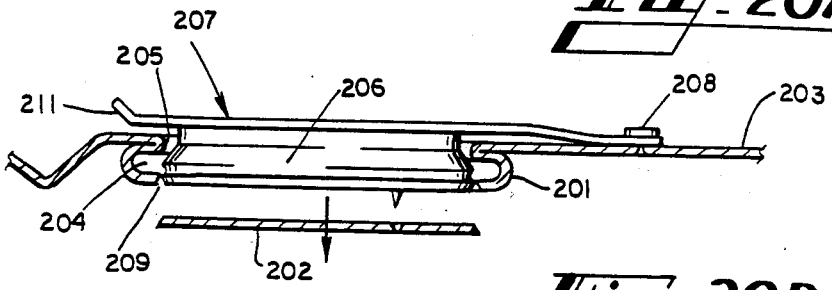
Figure 20C:
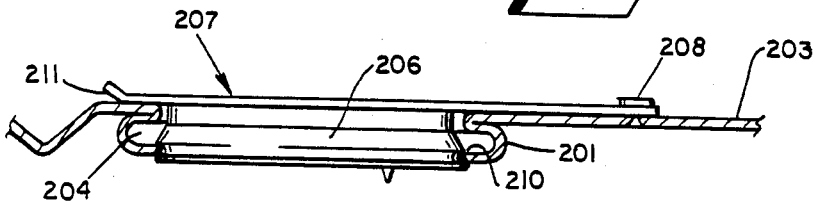
Figure 21A:
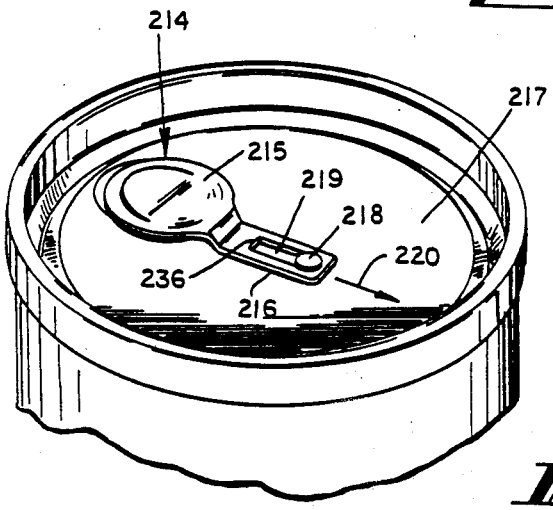
Figure 21B:
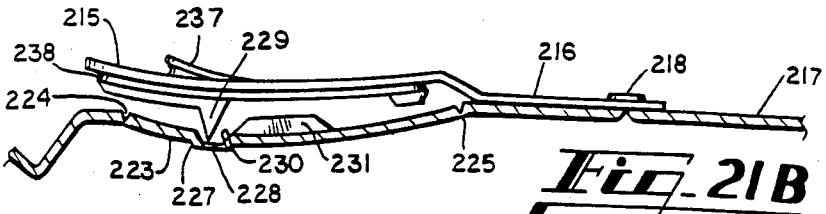
Figure 21C:
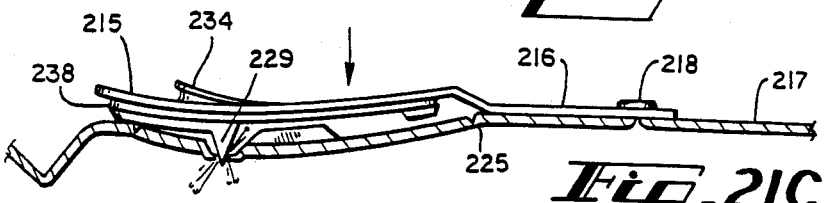
Figure 21D:
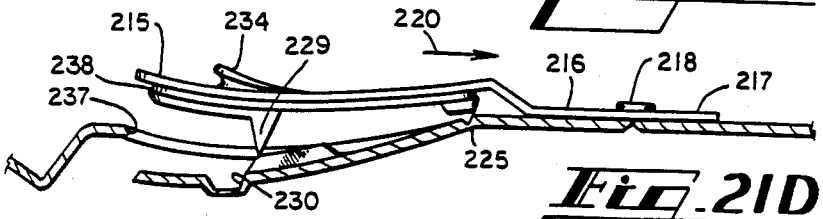
Figure 21E:
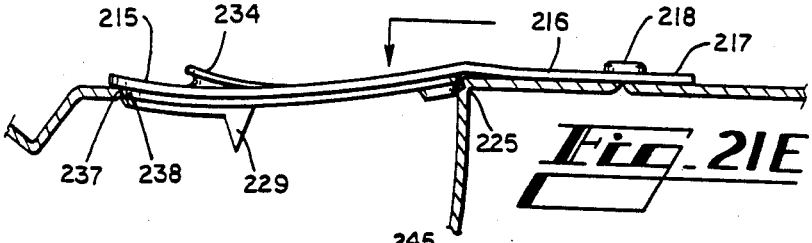
Figure 22:
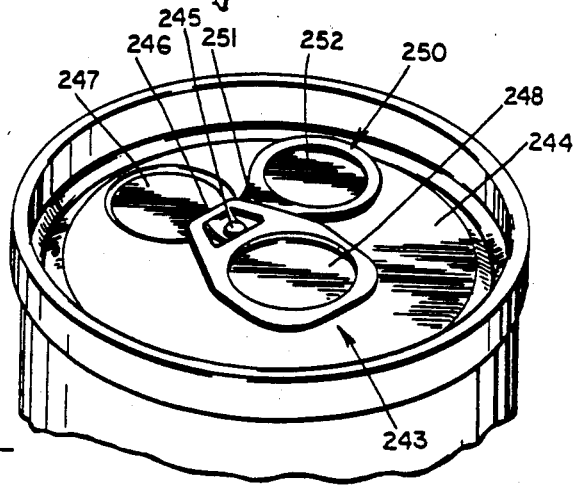
Figure 1:
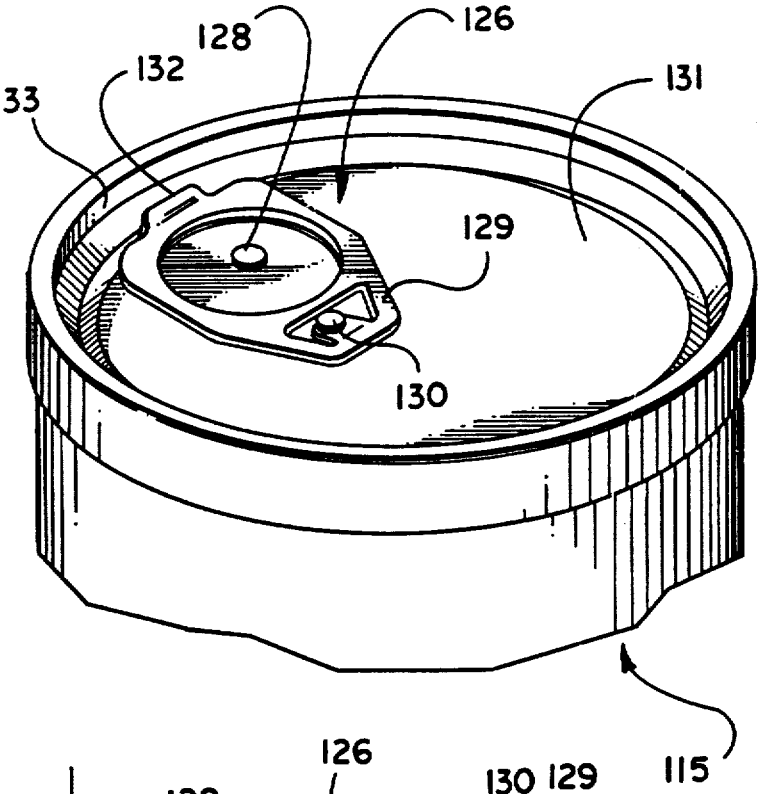
Figure 2:
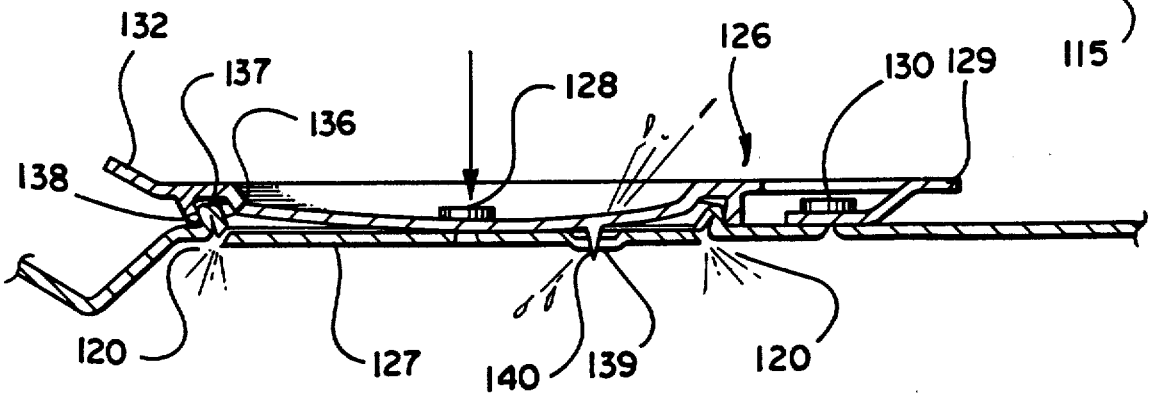
Figure 3:
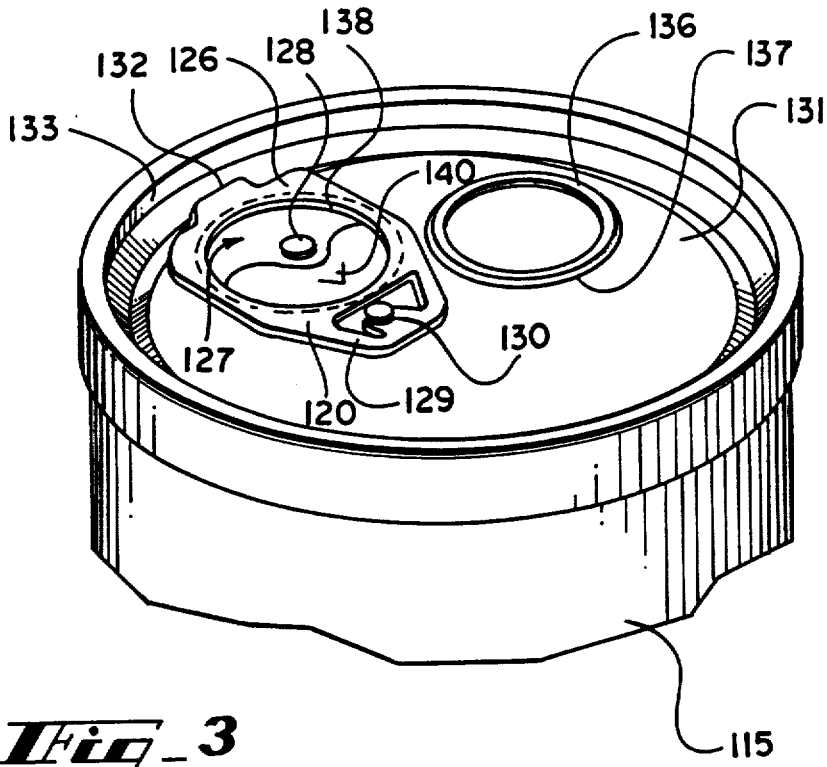
Figure 4:
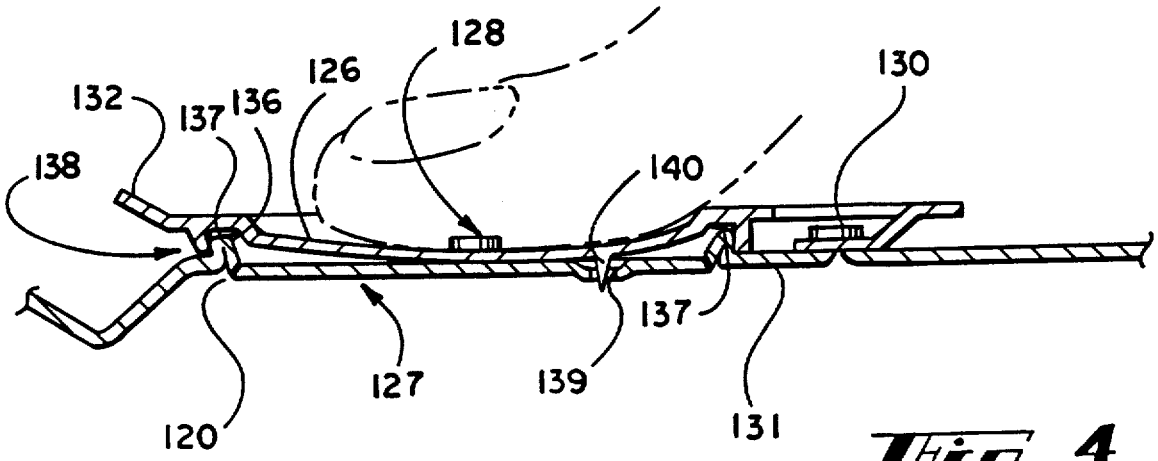

Before the can 115 shown in FIGS. 1 and 2 is initially opened, the tab 126 is non-movably secured to the end wall 131 by the rivets 128 and 130 concurrently. It can readily be seen that the reclosure flange 138 of the opening and reclosure tab 126 may be placed into locking engagement with the cooperative raised rim 136 of the end wall 131 prior to opening of the openable panel member 127. A more special significance of this is that the openable panel member 127 and all of the immediately surrounding area remains sealed off from contamination and undesirable elements prior to the opening of the pour area. Another factor of serious consideration is in the manufacturing and distribution of the finished product, whereby the entire opening and reclosure tab member 126 will rest below the level of the chime 133, FIGS. 1 and 3, so that the end walls 131 are readily stackable.

To open the can 115, one first presses downwardly on the tab 126 in the vicinity of the spike 140 formed on the underside of the tab, to pierce the weakened region 139 located on the openable end panel 127. With container gas pressure thus released, continued downward force on the tab 126 fractures the separable region 120 and completely separates the panel 127 from the rest of the wall 131. The tab 126 may now be lifted by the finger flange 132 to raise the separated panel 127 a limited distance above the outer surface of the end wall 131, after which the tab 126 with attached panel 127 is pivoted in combination about the rivet 130 to expose the pour opening in the end wall 131 as seen in FIG. 3.

The rivet 128 in the opening panel member 127 is preferably located in the center of the panel 127 for reasons of manufacture, construction, and attachment to the panel. However, it is to be clearly recognized that the rivet 128 in the openable panel 127 may alternatively be located at any other location within the panel 127 for reasons of efficiency, space, total design and the like. The tab 126 may alternatively be attached to the openable panel 127 by other bonding means known in the art, thus eliminating the rivet 128 in openable panel 127.

To reclose the pour opening formed in the end wall 131, the tab 126 and openable panel member 127 are pivotably returned to a position in registry with the opening in the end wall. The tab 126 is then pressed downwardly against the end wall 131, snap-engaging the flange 138 of the tab 126 with the flange 137 on the raised rim 136 surrounding the opening. The container is now reclosed until again reopened by applying upward manual force to the finger flange 132. A compound lining material may be applied to the bottom portions of the tab engaging rim 136 during reclosure, to facilitate the sealing effect of reclosure.

It should be apparent that the foregoing description and disclosure relate only to the disclosed embodiment, and that numerous modifications and alterations may be made therein without departing from the spirit and scope of the invention as defined in the following claims.

I claim:

1. A selectably reclosable easy-opening container apparatus comprising:

a container wall having an outer surface and an inner surface;

an openable panel member defined in said wall by a selectively separable region of predetermined weakness;

a raised flange on said wall surrounding said separable region;

a unitarily constructed opening and reclosure tab member secured to said wall by first and second attachment means;

said first means located outside said openable panel member to secure the tab member to the wall;

said second means located in said openable panel member and across said region of weakness from said first attachment means to secure the panel member to the tab member;

said opening and reclosure tab member having a closure engaging means selectively operable to engage said raised flange, wherein said raised flange on said wall and said flange engaging means on said tab member form a seal over said openable panel member prior to opening and separation of said openable panel member from said container wall;

said tab member having means confronting said wall in the vicinity of said region of weakness and operative to separate the region of weakness when the tab is first pressed downwardly to separate and displace said openable panel member and is then lifted up a limited distance to pivot said connected tab member and said panel member across said wall; and said tab and said opened panel member are thereby pivotable across said end wall around said first attachment means while the second attachment means moves with the tab member and the opened panel member, so as to provide a pour opening in the container wall.

2. A container wall having an outer surface and an inner surface;

an openable panel member defined in said wall by a first selectively separable region of predetermined weakness;

a second region of selectively separable predetermined weakness forming a vent means located within said openable panel member;

a raised flange on said wall surrounding said first and second separable regions;

a unitarily constructed opening and reclosure tab member having a spike means on the underside of said tab member;

said tab member secured to said wall by a first and second attachment means;

said first means located outside said openable panel member to secure said tab member to said wall;

said second means located in said openable panel member and across said region of weakness from said first attachment means to secure said panel member to said tab member; and said opening and reclosure tab member having a flange engaging means selectively operable to engage said raised flange, wherein said raised flange on said wall and said flange engaging means on said tab member form a seal over said openable panel member prior to opening and separation of said openable panel member and said vent means from said container wall.

3. An apparatus as in claim 2, wherein:

said tab member having means confronting said wall in the vicinity of said first region of weakness and operative to separate said first region of weakness when downward pressure is applied to separate and displace said openable panel member;

said spike means on the underside of said tab member is in confronting relationship with said wall in the vicinity of said second region of predetermined weakness located within said openable panel member; and said spike means is operative to separate said second region of weakness when downward pressure is applied to separate and displace said openable panel member means from said wall, thereby releasing gases held within said container prior to the separation of said first region of predetermined weakness forming said openable panel member.

4. An apparatus as in claim 2, wherein:

said raised flange on said wall and said flange engaging means on said tab member cooperate to form a reseal over said openable panel member with said openable panel member remaining attached to the underside of said tab member, after said panel member has been separated and displaced from said container wall, whereby said container is resealed by pivoting said tab member along said wall to a position wherein said flange engaging means of said tab member is in cooperative alignment with said raised flange of said wall.

5. A container as in claim 2, wherein said unitary opening and reclosure tab member and said severed openable panel member are jointly liftable and pivotable across the top of said container wall after said openable member has been separated from said end wall.

6. Apparatus as in claim 2, wherein said first selectively separable region forms a completely separable loop in said container wall, so that the openable panel member becomes completely separated from the container wall when the first separable region becomes separated.

7. A selectably reclosable easy-open container apparatus, comprising:

a container wall having an outer surface and an inner surface;

an openable panel member defined in said wall by a selectively separable region of predetermined weakness;

a raised flange on said wall surrounding said separable region;

a unitarily constructed opening and reclosure tab member secured to said wall by first and second attachment means;

said first means located outside said openable panel member to secure the tab member to the wall;

said second means located in said openable panel member and across said region of weakness from said first attachment means to secure said panel member to said tab member;

said opening and closure tab member having a closure engaging means selectively operable to engage said raised flange, wherein said raised flange on said wall and said flange engaging means on said tab member form a seal over said openable panel member, and wherein said tab closure engaging means and said raised flange engaging means on said end wall member remain sealed as downward pressure is applied to said tab member toward said openable panel member in the vicinity of said selectively severable region of predetermined weakness, causing said region to sever and separate the panel member from said wall.

* * * * *

UNITED STATES PATENT AND TRADEMARK OFFICE

CERTIFICATE OF CORRECTION

PATENT NO. : 4,821,912

DATED : April 18, 1989

INVENTOR(S) : Robert A. Wells

It is certified that error appears in the above-identified patent and that said Letters Patent is hereby corrected as shown below:

The Title Page should be deleted to appear as per attached title page.

Figures 1 - 22 of the drawings should be deleted to be replaced with Figures 1 - 4 as shown on the attached sheets.

On the title page, "7 Claims, 11 Drawing Sheets" should read

-- 7 Claims, 2 Drawing Sheets --.

Signed and Sealed this

Second Day of January, 1990

*Attest:*

JEFFREY M. SAMUELS

*Attesting Officer*

*Acting Commissioner of Patents and Trademarks*

United States Patent [19]

Wells

[11] Patent Number: 4,821,912

[45] Date of Patent: Apr. 18, 1989

[54] RECLOSABLE SELF-OPENING CAN END

[76] Inventor: Robert A. Wells, 13 Fairway Dr., Kennesaw, Ga. 30144

[21] Appl. No.: 57,222

[22] Filed: Jun. 2, 1987

Related U.S. Application Data

[62] Division of Ser. No. 410,422, Aug. 25, 1982, Pat. No. 4,673,099.

[51] Int. Cl.[4] ..... B65D 41/32

[52] U.S. Cl. ..... 220/231; 220/267; 220/268; 220/277; 220/278

[58] Field of Search ..... 220/269, 268, 271, 277, 220/267, 231

[56] References Cited

U.S. PATENT DOCUMENTS

| | | | |
|---|---|---|---|
| 2,294,102 | 8/1942 | Vargo . | |
| 3,281,024 | 10/1966 | Henchert et al. . | |
| 3,804,287 | 4/1974 | Balocca et al. . | |
| 3,880,319 | 4/1975 | Wells et al. . | |
| 4,003,493 | 1/1977 | Wells et al. . | |
| 4,039,101 | 8/1977 | Wells | 220/269 |
| 4,189,060 | 2/1980 | Trotman III | 220/269 |
| 4,207,991 | 6/1980 | Amabili | 220/269 |
| 4,215,791 | 8/1980 | Brochman | 220/269 |
| 4,232,797 | 11/1980 | Waterbury . | |
| 4,238,040 | 12/1980 | Vogt | 220/269 |
| 4,391,385 | 7/1983 | Rausing . | |
| 4,442,950 | 4/1984 | Wilson . | |

*Primary Examiner*—Joseph Man-Fu Moy

*Attorney, Agent, or Firm*—Jones, Askew & Lunsford

[57] ABSTRACT

A easy-open beverage container which can be selectably reclosed and reopened, after the container initially is opened. The reclosure structure may be contained on an opening tab, or alternatively may be separate from the tab.

7 Claims, 11 Drawing Sheets

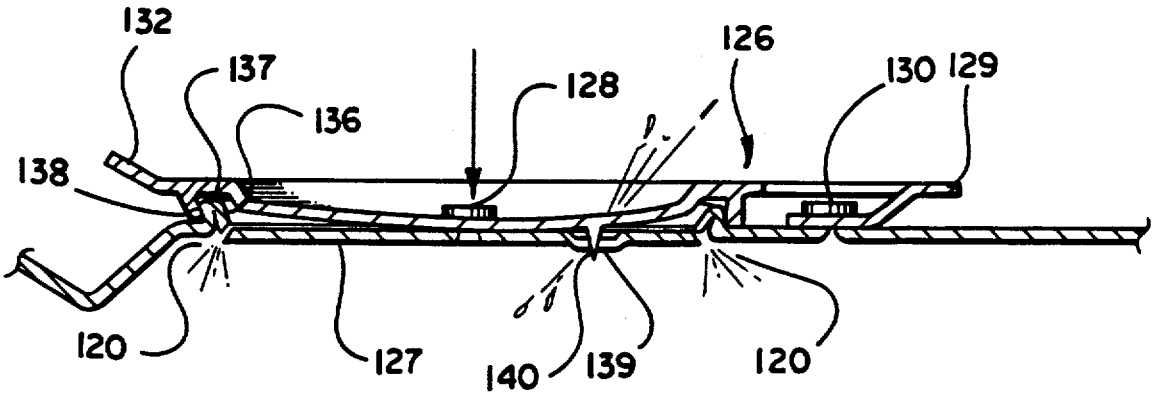

Patent No. 4,821,912

April 18, 1989

Robert A. Wells

Patent No. 4,821,912

April 18, 1989

Robert A. Wells